US006322408B1

(12) United States Patent
Latham

(10) Patent No.: US 6,322,408 B1
(45) Date of Patent: Nov. 27, 2001

(54) BRACKET CONNECTING OUTDRIVE TO STEERING AND/OR TIE BAR

(76) Inventor: Robert P. Latham, 280 SW. 32nd Ct., Fort Lauderdale, FL (US) 33315

( * ) Notice: Subject to any disclaimer, the term of this patent is extended or adjusted under 35 U.S.C. 154(b) by 0 days.

(21) Appl. No.: 09/668,534

(22) Filed: Sep. 25, 2000

(51) Int. Cl.[7] ..... B63H 5/125
(52) U.S. Cl. ..... 440/63; 114/144 R
(58) Field of Search ..... 114/144 R, 144 A; 440/53, 55, 57, 61–63

(56) References Cited

U.S. PATENT DOCUMENTS

| | | | |
|---|---|---|---|
| 3,756,186 | 9/1973 | Nordling | 115/18 R |
| 4,573,930 | 3/1986 | Queen | 440/56 |
| 4,778,418 | 10/1988 | Mondek | 440/63 |
| 4,964,354 * | 10/1990 | Latham | 114/144 R |
| 5,466,178 | 11/1995 | Inman | 440/61 |

OTHER PUBLICATIONS

Latham Marine Inc. 2/95 Brochure.

* cited by examiner

*Primary Examiner*—Stephen Avila
(74) *Attorney, Agent, or Firm*—Alvin S. Blum

(57) ABSTRACT

A bracket for connecting steering mechanisms and or tie bars to a marine propulsion outdrive that fastens to the outside of the upper and rear cover plates of the outdrive using threaded fasteners that replace fasteners that originally secured the top and rear cover plates. The cover plates do not need to be removed to install the bracket. The bracket is secured by both horizontal and vertical threaded fasteners for greater strength.

14 Claims, 9 Drawing Sheets

BRACKET CONNECTING OUTDRIVE TO STEERING AND/OR TIE BAR

BACKGROUND OF THE INVENTION

This invention relates to external connectors for marine propulsion steering, and more particularly to apparatus for connecting an outdrive unit to a steering mechanism and/or to another outdrive unit through a tie bar.

DESCRIPTION OF THE PRIOR ART

Outdrive units for marine propulsion often are provided with steering attachments within the boat. For greater precision and stability in steering, it is desirable to attach the steering mechanism to the outside of the outdrive housing away from the vertical axis about which the unit pivots in steering. When a plurality of outdrive units are mounted on the transom, they are joined together by one or more tie bars that are also attached to the outside of the outdrive housings. Various means have been used for attaching the steering and tie bars to the housing. It is common practice to replace a portion of the housing with a like portion to which attachment elements have been fastened. In the case of the BRAVO brand outdrive from MERCURY MARINE CORP, a rear cover plate bolted onto the housing to close off a lubricant chamber housing gears is removed. It is replaced with a plate carrying attachment elements for tie bars and/or steering. This necessitates draining the lubricant and exposing the chamber to contamination. Furthermore, the great stresses on the housing are all borne by the horizontal threaded bolt holes on the housing that are only designed to hold the plate in place as a closure.

SUMMARY OF THE INVENTION

It is accordingly an object of the invention to provide a bracket that can be attached to the outside of an outdrive housing without removing any portion of the housing, except some bolts. It is yet another object that the bracket be attached to the housing by bolts that are vertically oriented, and also by bolts that are horizontally oriented for better distribution of forces onto the housing.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
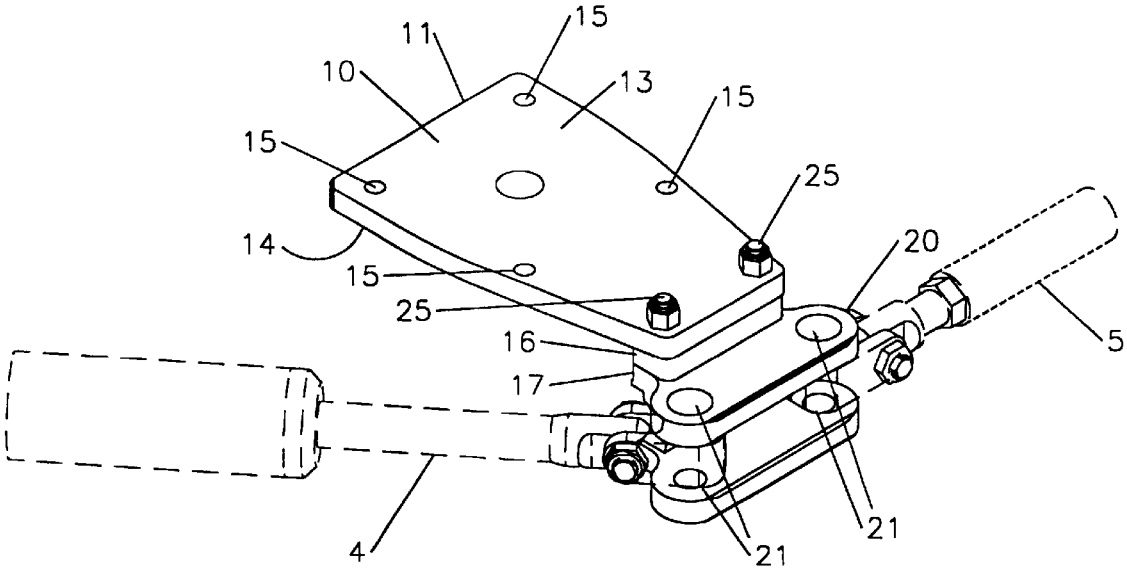
FIG. 1 is a perspective view of the bracket of the invention.
Figure 2:
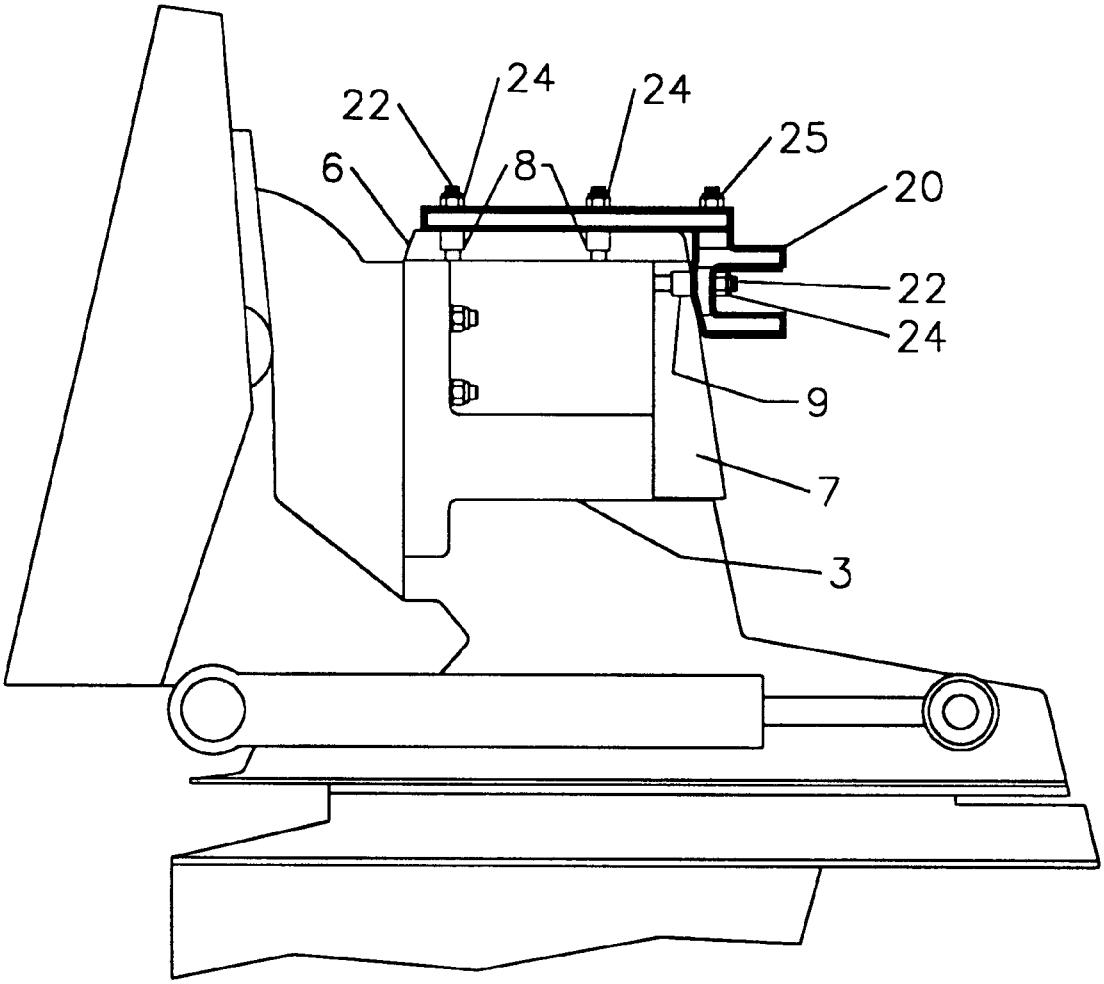
FIG. 2 is a side view of the installed bracket.
Figure 3:
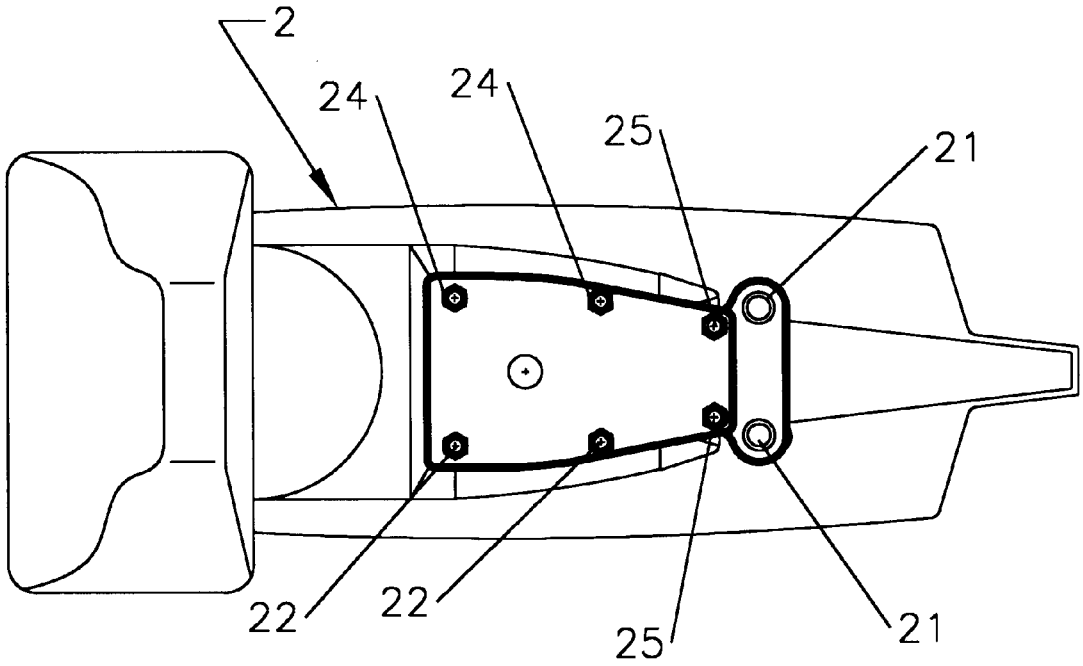
FIG. 3 is a top view of the installed bracket.
Figure 4:
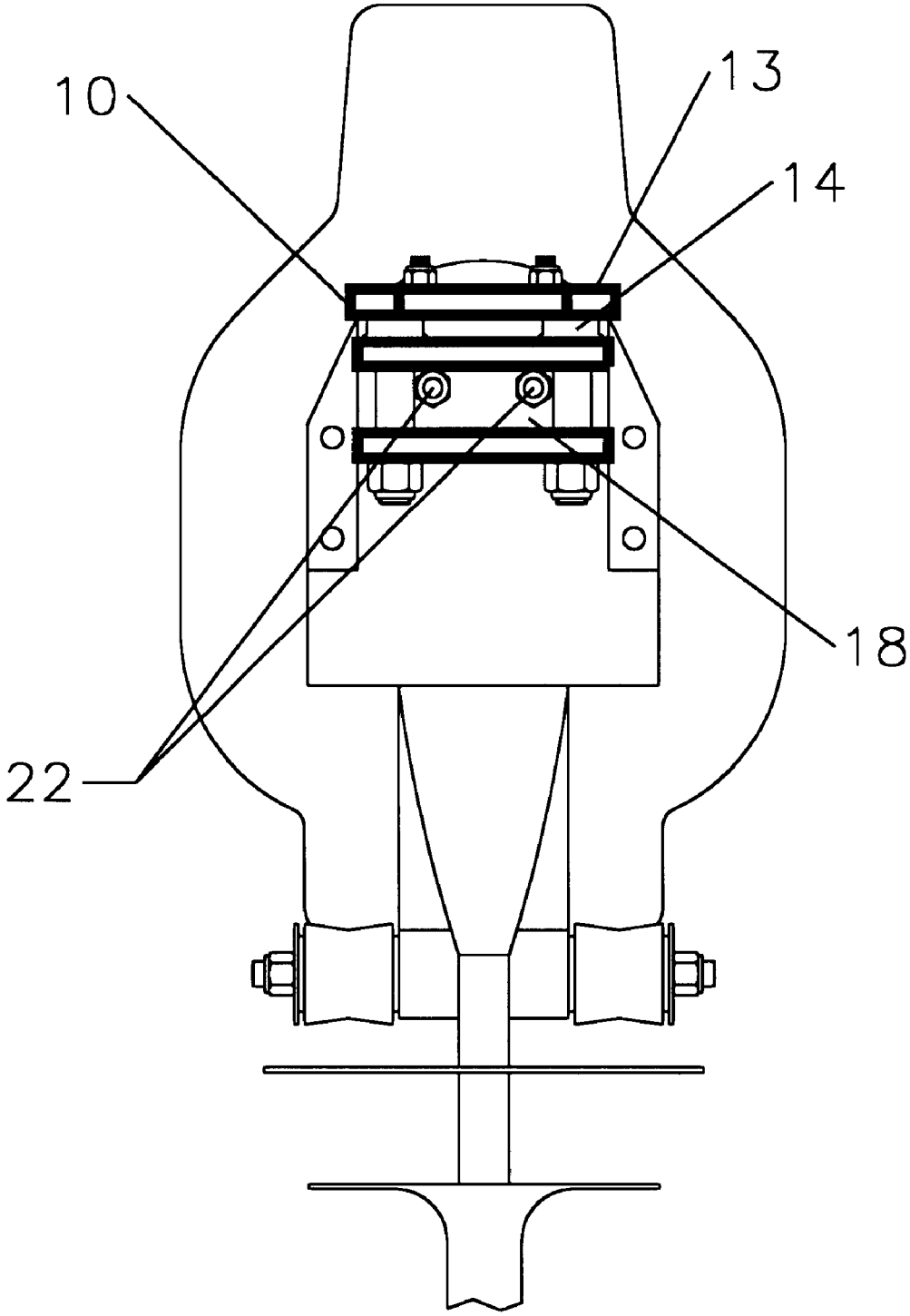
FIG. 4 is a rear view of the installed bracket.
Figure 5:
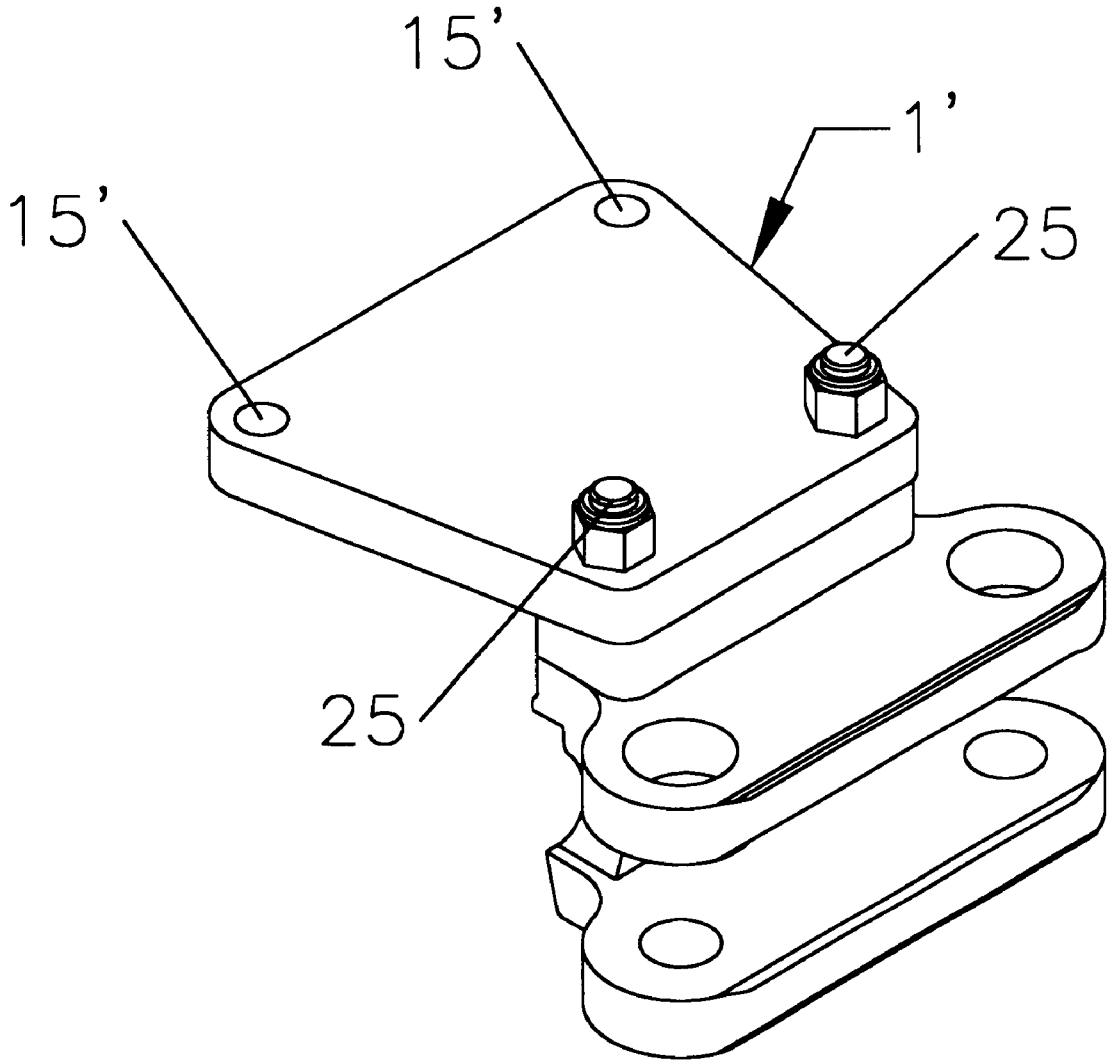
FIG. 5 is a perspective view of another embodiment of the bracket of the invention.
Figure 6:
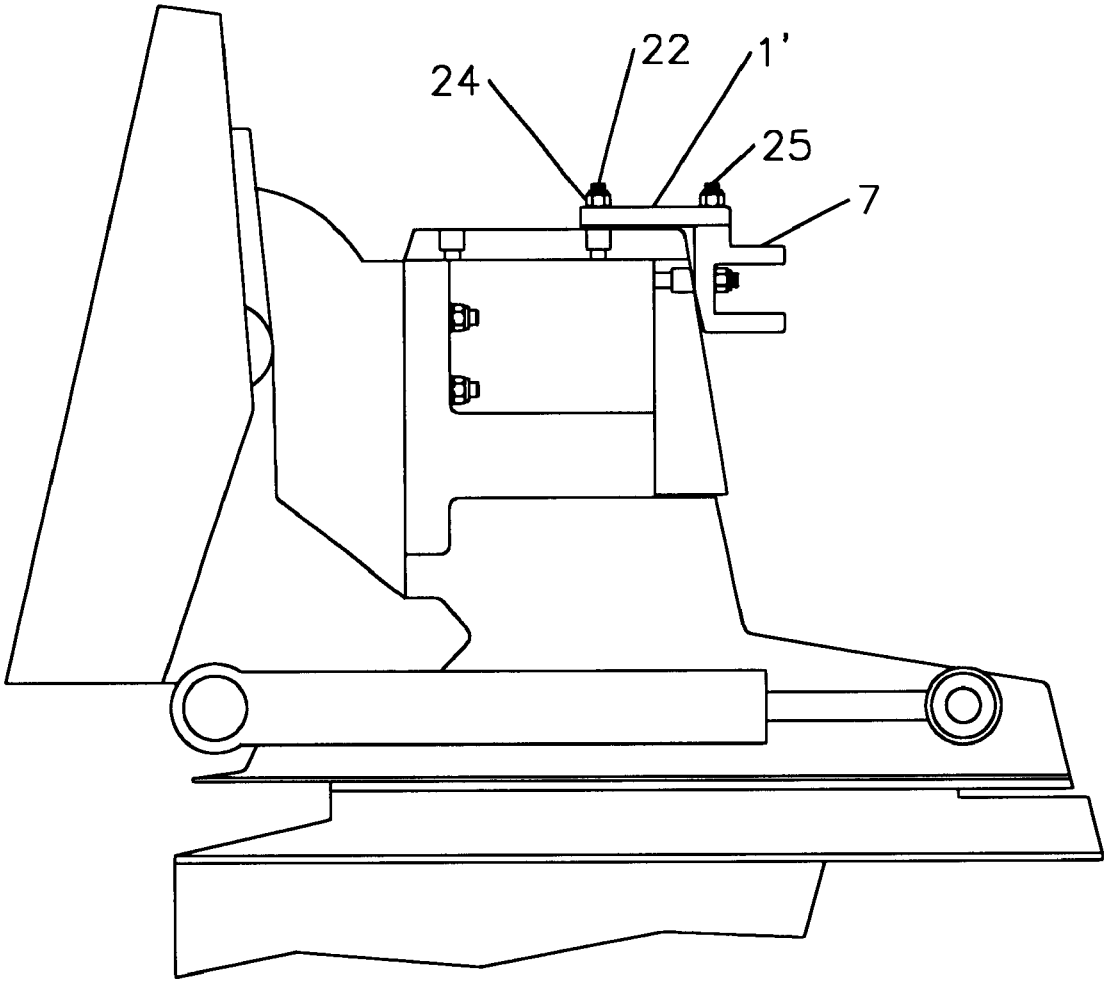
FIG. 6 is a side view of the installed bracket of FIG. 5.
Figure 7:
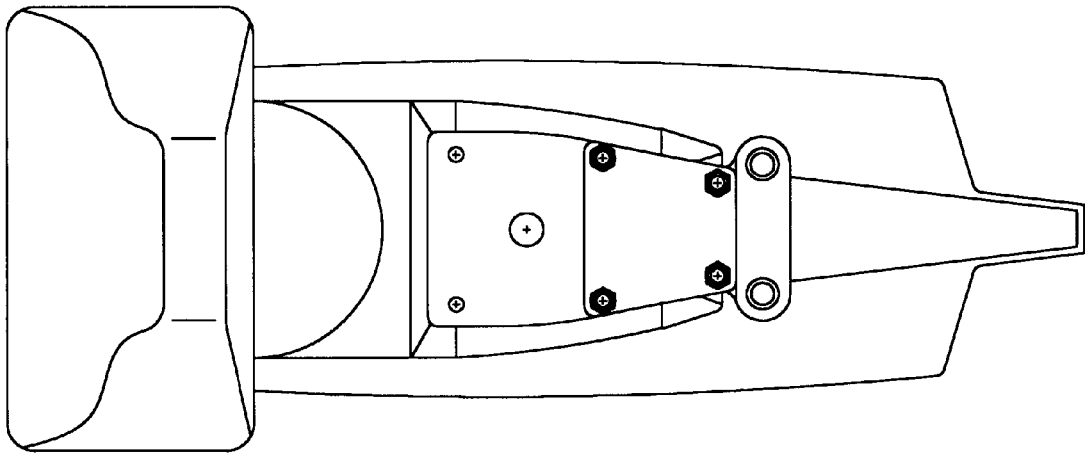
FIG. 7 is a top view of the installed bracket of FIG.5
Figure 8:
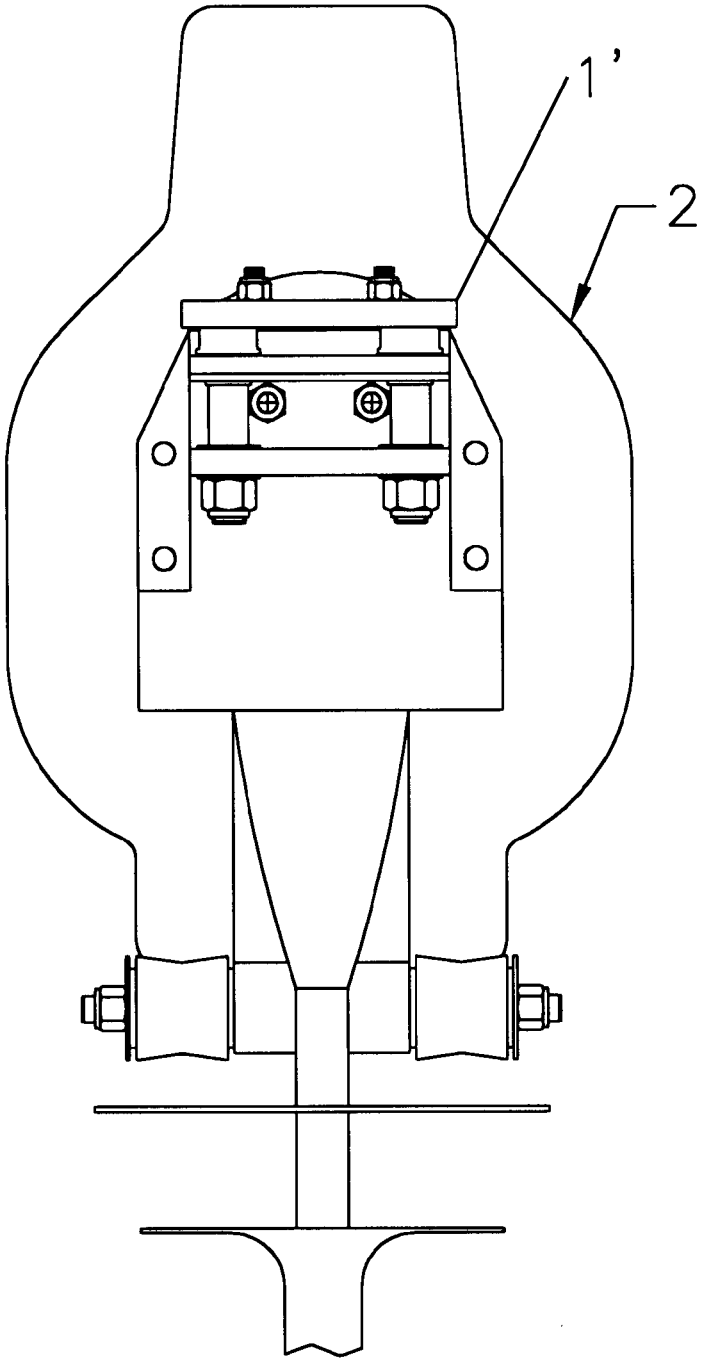
FIG. 8 is a rear view of the installed bracket of FIG. 5.

Referring now to the drawing FIGS. 1–4, a conventional outdrive 2 for mounting on the transom of a boat (not shown), such as the BRAVO outdrive made by MERCURY MARINE CORP. has an external housing 3. A top cover plate 6 sealingly closes off a chamber containing gears in a lubricant. The cover plate 6 is held in place by bolts in threaded vertical holes 8 in the housing. A rear cover plate 7 also sealingly closes off the chamber. It is held in place by bolts in threaded horizontal holes 9 in the housing.

A bracket 1 of the invention has a first rigid planar member 10 with a forward end 11, a rear end 12, a broad upper face 13, and a broad lower face 14 that fits flat against at least a portion of the top cover plate 6. Four apertures 15 between the upper and lower faces correspond to the position of bolts holding the top cover in place.

A second rigid member 16 is affixed by bolts 25 to the rear end 12 substantially orthogonal to the lower face 14 and extending downward therefrom. It has a broad forward face 17 that is secured to at least a portion of the rear cover plate 7, and a rear face 18. Two apertures between faces 17 and 18 correspond to the position of bolts holding the rear cover plate in place. A pair of rigid spaced-apart projections 20 extend rearwardly from the rear face 18. Apertures 21 in the projections are adapted to receive connectors to steering mechanisms 4 (shown in phantom) and/or tie bars 5 (shown in phantom).

The bracket 1 may be installed on the outdrive without removing either the top or rear cover plates, thus eliminating the need to drain lubricant, and ensuring against contamination of the gear chamber. The bolts holding the top plate are replaced with elongate studs 22 that are received in threaded vertical holes 8 in the housing and spacers 23 that fit into the countersunk holes in the top cover plate. The first rigid planar member 10 is then positioned on the top cover plate 6 and onto the vertical studs 22. The member 10 is then drawn down tightly with nuts 24.

Two bolts holding the rear cover plate in place are then removed and replaced with horizontal studs 22' with spacers that are received in threaded horizontal holes 9. The second rigid member is then fitted on the rear cover plate, and onto the studs 22', and secured with nuts 24. Elongate threaded fasteners 25 are then used to affix the members 10 and 16 together at right angles. The bracket is now held securely in two directions. In an alternative embodiment, not shown, only one rigid projection 20 may extend rearwardly from the rear face 18 for receiving connectors to the steering mechanisms and/or tie bars.

Referring now to FIGS. 5–8, a similar bracket 1' is shown that has only two apertures 15' for securing onto the top cover plate.

Figure 9:
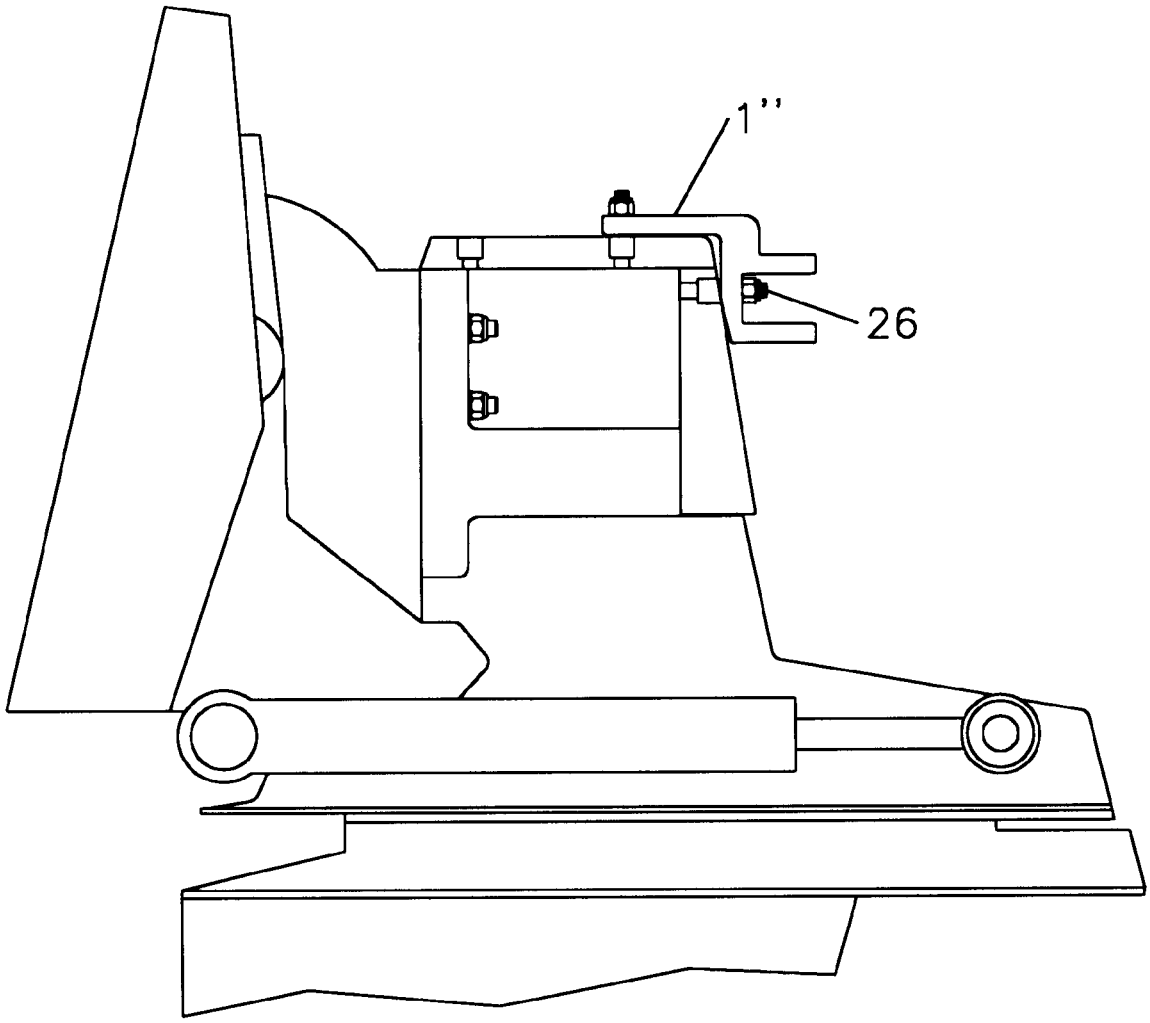
FIG. 9 is a side view of another embodiment of the bracket of the invention, installed.

FIG. 9 shows another bracket 1" in which the entire bracket is formed from a single piece of material, such as by extrusion or molding, of metal or plastic. The top bolts are replaced with studs as in the other embodiments. The horizontal bolts are removed and replaced with longer bolts 26 and spacers, after the bracket is in place.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A bracket for connecting steering mechanisms and/or tie bars to the outer housing of an outdrive in which the housing includes a top cover plate held on with bolts received in vertical threaded holes and a rear cover plate held on with bolts received in horizontal threaded holes, the bracket comprising:

a) a first rigid planar member having a forward end, a rear end, a broad upper face, and an opposed broad lower face provided with at least two apertures between the upper and lower faces corresponding to the positions of the bolts in the top cover plate;

b) a second rigid member affixed substantially orthogonal to the first rigid planar member at the rear end thereof extending downward therefrom, and having a broad forward face, a rear face, and provided with two apertures between the forward and rear faces corresponding to the positions of the bolts in the rear cover plate;

c) a pair of spaced apart projections extending rearwardly from the rear face of the second member, the projections provided with apertures for receiving connectors to steering and or tie bar mechanisms; and d) the bracket adapted to be attached to the housing adjacent the top cover plate and the rear cover plate with threaded fasteners that are received in the vertical and horizontal threaded holes that were originally used to attach only the cover plates.

2. The bracket according to claim 1, in which there are four apertures in the first rigid member.

3. The bracket according to claim 1, in which there are two apertures in the first rigid member.

4. The bracket according to claim 3, in which the bracket is formed from a single piece of material.

5. The bracket according to claim 2, in which the bracket is formed from a single piece of material.

6. The bracket according to claim 1, in which the bracket is formed from a single piece of material.

7. The bracket according to claim 1, in which the first and second rigid members are affixed by threaded fasteners.

8. A bracket for connecting steering mechanisms and/or tie bars to the outer housing of an outdrive in which the housing includes a top cover plate held on with bolts received in vertical threaded holes and a rear cover plate held on with bolts received in horizontal threaded holes, the bracket comprising:

a) a first rigid planar member having a forward end, a rear end, a broad upper face, and an opposed broad lower face provided with at least two apertures between the upper and lower faces corresponding to the positions of the bolts in the top cover plate;

b) a second rigid member affixed substantially orthogonal to the first rigid planar member at the rear end thereof extending downward therefrom, and having a broad forward face, a rear face, and provided with two apertures between the forward and rear faces corresponding to the positions of the bolts in the rear cover plate;

c) a rigid projection extending rearwardly from the rear face of the second member, the projection provided with apertures for receiving connectors to steering and or tie bar mechanisms; and d) the bracket adapted to be attached to the housing adjacent the top cover plate and the rear cover plate with threaded fasteners that are received in the vertical and horizontal threaded holes that were originally used to attach only the cover plates.

9. The bracket according to claim 8, in which there are four apertures in the first rigid member.

10. The bracket according to claim 8, in which there are two apertures in the first rigid member.

11. The bracket according to claim 10, in which the bracket is formed from a single piece of material.

12. The bracket according to claim 9, in which the bracket is formed from a single piece of material.

13. The bracket according to claim 8, in which the bracket is formed from a single piece of material.

14. The bracket according to claim 8, in which the first and second rigid members are affixed by threaded fasteners.

* * * * *